US008647137B2

(12) United States Patent
Kimura

(10) Patent No.: US 8,647,137 B2
(45) Date of Patent: Feb. 11, 2014

(54) CONNECTOR

(75) Inventor: Masaki Kimura, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 50 days.

(21) Appl. No.: 13/533,243

(22) Filed: Jun. 26, 2012

(65) Prior Publication Data

US 2012/0329335 A1 Dec. 27, 2012

(30) Foreign Application Priority Data

Jun. 27, 2011 (JP) ..... 2011-142287

(51) Int. Cl.
*H01R 13/62* (2006.01)

(52) U.S. Cl.
USPC ..... 439/326

(58) Field of Classification Search
USPC ..... 439/326
See application file for complete search history.

(56) References Cited

U.S. PATENT DOCUMENTS 5,425,651 A * 6/1995 Thrush et al. ..... 439/326
6,527,576 B1 * 3/2003 Omote ..... 439/326
7,059,883 B2 * 6/2006 Tsai ..... 439/326
7,682,179 B1 * 3/2010 Tsai ..... 439/326
8,123,542 B2 * 2/2012 Kimura et al. ..... 439/326
2002/0009914 A1 * 1/2002 Yahiro et al. ..... 439/326
2004/0092148 A1 * 5/2004 Yu ..... 439/326
2006/0105605 A1 * 5/2006 Liao et al. ..... 439/326
2009/0197452 A1 * 8/2009 Fumikura ..... 439/326

FOREIGN PATENT DOCUMENTS

JP 9-45437 A 2/1997
JP 9-139261 A 5/1997

* cited by examiner

*Primary Examiner* — Gary Paumen
(74) *Attorney, Agent, or Firm* — Holtz, Holtz, Goodman & Chick, PC

(57) ABSTRACT

A connector according to the present invention comprises a housing and a plurality of contacts. The housing includes a mating portion having a plate shape. The mating portion projects forward and has an upper surface and a bottom surface. The plurality of contacts is held by the housing. Each of the contacts comprises a contact portion, an end portion and a flat portion. The contact portion extends in a connection direction and is exposed at the upper surface of the mating portion. The end portion is embedded in the mating portion. The flat portion forms a boundary between the contact portion and the end portion and does not projects from the upper surface. The flat portion is able to be viewed from above the upper surface of the mating portion.

12 Claims, 8 Drawing Sheets

CONNECTOR

CROSS REFERENCE TO RELATED APPLICATIONS

Applicant claims priority under 35 U.S.C. §119 of Japanese Patent Application No. JP 2011-142287 filed Jun. 27, 2011.

BACKGROUND OF THE INVENTION

The present invention relates to an electrical connector such as a card-edge connector. The electrical connector is connected with a connection object which has mating portion having a plate-like shape. The connection object is, for example, a semiconductor module such as a memory module.

Electrical connectors of the above-mentioned type are disclosed in JP-A H9-139261 and JP-A H9-45437, each of which is incorporated herein by reference in their entirety. The electrical connector disclosed in JP-A H9-139261 is a card-edge connector connected with a card. The card is inserted to the card-edge connector in an obliquely direction and is brought down till the card is in parallel with a horizontal direction so that the card-edge connector is connected with the card. The card is engaged with an engaged portion (a latch portion) of the card-edge connector so that a connection between the card-edge connector and the card is maintained. The electrical connector disclosed in JP-A H9-45437 is connected with a cable connector. The cable connector is inserted to the electrical connector in an oblique direction and is brought down till the cable connector is in parallel with the horizontal direction so that the electrical connector is connected with the cable connector. An engage portion of the cable connector is engaged with an engaged portion (recessed portion) of the electrical connector so that connection between the electrical connector and the cable connector is maintained.

Connection objects (the card and the cable connector) mentioned above can be inserted to the electrical connectors with low insertion force even when the electrical connectors have a plurality of contacts.

However, the connection object receives restoring force by the contacts of the electrical connector when the connection object is connected with the electrical connector. Because of the restoring force by the contacts, the connection object may be bent and deformed. Therefore, the connection objects connected with the above electrical connectors are required to be strong. In other words, a thin connection objects can not be used for the above electrical connectors.

SUMMARY OF THE INVENTION

It is therefore an object of the present invention to provide an electrical connector which does not apply excessive force to a connection object while the electrical connector and a connection object are connected with each other.

One aspect of the present invention provides an electrical connector configured to be connected with a connection object which has a mating portion having a plate shape. The electrical connector comprises: an insertion opening into which the connection object is inserted in an oblique direction; a contacted portion with which the mating portion inserted through the insertion opening is brought into contact; a receiving portion receiving the mating portion and having a first support portion, the receiving portion being positioned at a back of the contacted portion; a contact portion positioned forward and upward of the first support portion and being displaceable in an up-down direction; and a second support portion positioned forward and downward of the contact portion. The mating portion is inserted through the insertion opening so as to be positioned at a first position where the mating portion is in contact with the contacted portion, the mating portion being brought down so as to be positioned at a second position where the mating portion is in parallel with a front-back direction perpendicular to the up-down direction, the mating portion being moved backward so as to be positioned at a third position where the mating portion is received by the receiving portion and supported by the first support portion, the second support portion, and the contact portion.

An appreciation of the objectives of the present invention and a more complete understanding of its structure may be had by studying the following description of the preferred embodiment and by referring to the accompanying drawings.

Figure 1:
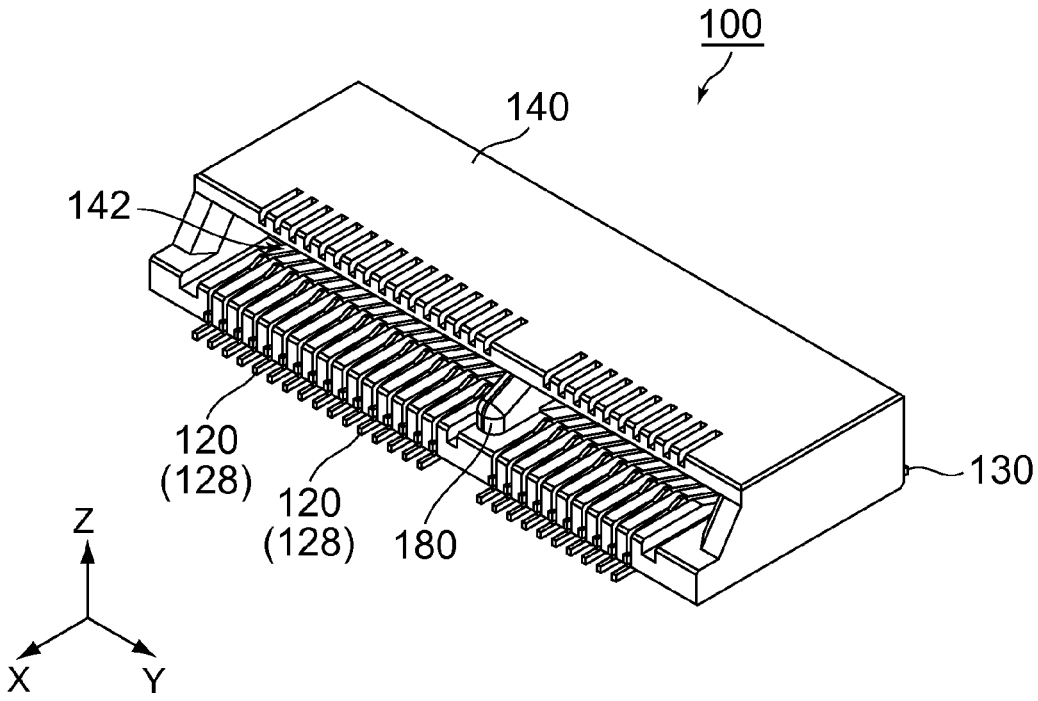
FIG. 1 is an oblique view showing an electrical connector according to an embodiment of the present invention.

While the invention is susceptible to various alternative embodiments and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all alternative embodiments, equivalents and alternatives falling within the spirit and scope of the present invention as defined by the appended claims.

DESCRIPTION OF PREFERRED EMBODIMENTS

With reference to FIG. 1 to FIG. 7, an electrical connector 100 of the embodiment according to the present invention comprises a plurality of upper contacts 110, a plurality of lower contacts 120, two hold downs 130 and a holding member 140. The upper contacts 110 and the lower contacts 120 are made of a conductive material. The holding member 140 is made of an insulative material. As shown in FIG. 8 to FIG. 11, the electrical connector 100 is a card-edge connector connected with a connection object 200. The connection object 200 of the embodiment is a module which has a substrate provided with a circuit and a semiconductor package. The module is for example a memory module. The connection object 200 of the embodiment has a mating portion 210 having a plate-like shape. The mating portion 210 is inserted into the electrical connector 100. The mating portion 210 has a plurality of upper contacts (not shown) formed on an upper surface 202 and a plurality of lower contacts (not shown) formed on a lower surface 204. The upper contacts and the lower contacts of the mating portion 210 are arranged near a front end portion 212 of the mating portion 210.

Figure 5:
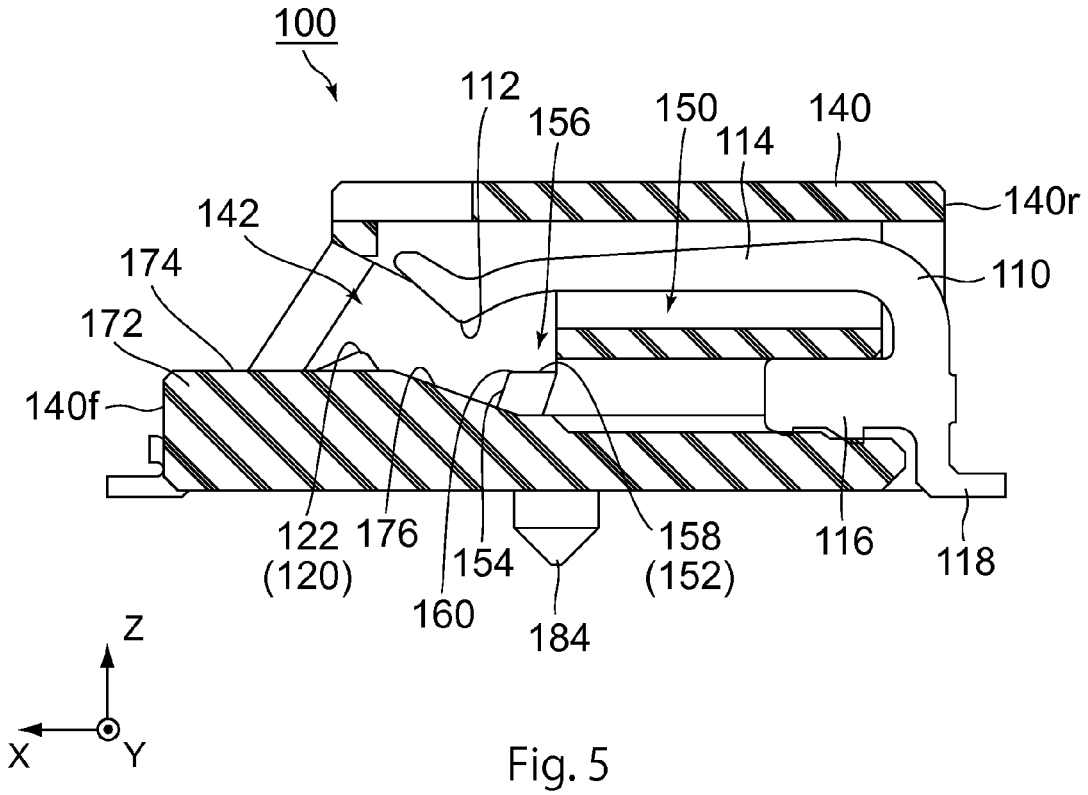
FIG. 5 is a cross-sectional view showing the electrical connector of FIG. 2, taken along lines V-V.

With reference to FIG. 5, the upper contact 110 has an upper contact portion (contact portion) 112, an upper spring portion 114, an upper held portion 116 and an upper fixed portion 118. The upper spring portion 114 extends forward (in a +X direction) and elastically supports the upper contact portion 112. The upper held portion 116 is press-fitted into the holding member 140 so that the upper contact 110 is held by the holding member 140. The upper fixed portion 118 is soldered to a substrate (not shown) on which the electrical connector 100 is installed. The upper contact portion 112 is positioned near a free end of the upper spring portion 114. The upper contact portion 112 is displaceable along an up-down direction (a Z direction) in a surface (in an XZ surface) defined by the up-down direction (a Z direction) and a front-back direction (an X direction). The upper contact portion 112 is brought into contact with a corresponding upper contact (not shown) of the mating portion 210. In this embodiment, the hold down 130 has only the upper held portion 116 and the upper fixed portion 118. The hold down 130 is soldered to the substrate so that the electrical connector 100 is fixed on the substrate.

Figure 6:
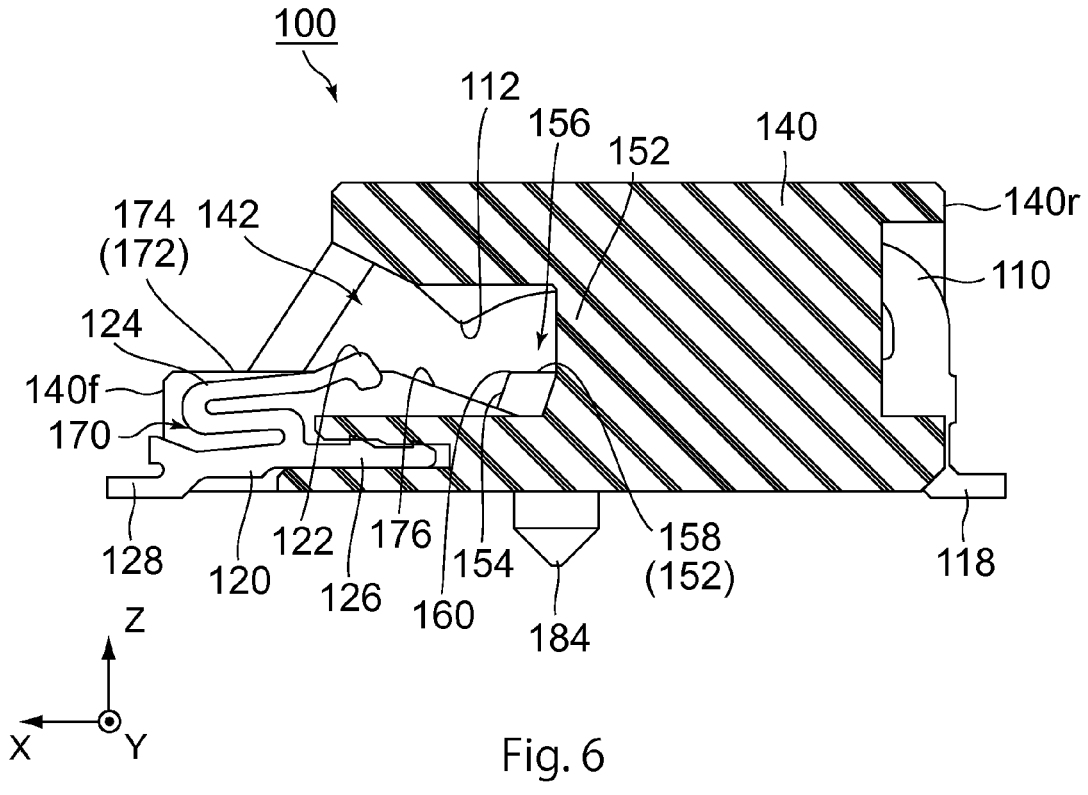
FIG. 6 is a cross-sectional view showing the electrical connector of FIG. 2, taken along lines VI-VI.

With reference to FIG. 6, the lower contact 120 has a lower contact portion 122, a lower spring portion 124, a lower held portion 126 and a lower fixed portion 128. The lower spring portion 124 has J-like shape and elastically supports the lower contact portion 122. The lower held portion 126 is press-fitted into the holding member 140 so that the lower contact 120 is held by the holding member 140. The lower fixed portion 128 is soldered to the substrate. The lower contact portion 122 is positioned near a free end of the lower spring portion 124. The lower contact portion 122 is displaceable along the up-down direction in the XZ surface and connected with the lower contact (not shown) of the mating portion 210. The lower contact portion 122 is brought into contact with a corresponding lower contact (not shown) of the mating portion 210.

With reference to FIG. 1 to FIG. 7, the holding member 140 has an insertion opening 142 into which the mating portion 210 is inserted. As shown in FIG. 8, the mating portion 210 is inserted along an oblique direction indicated with "D" in FIG. 8. The oblique direction of the embodiment is in a −X direction and a −Z direction). In other words, the mating portion 210 is inserted into the insertion opening 142 at a predetermined angle indicated with "A" in FIG. 8 with respect to the front-back direction.

Figure 7:
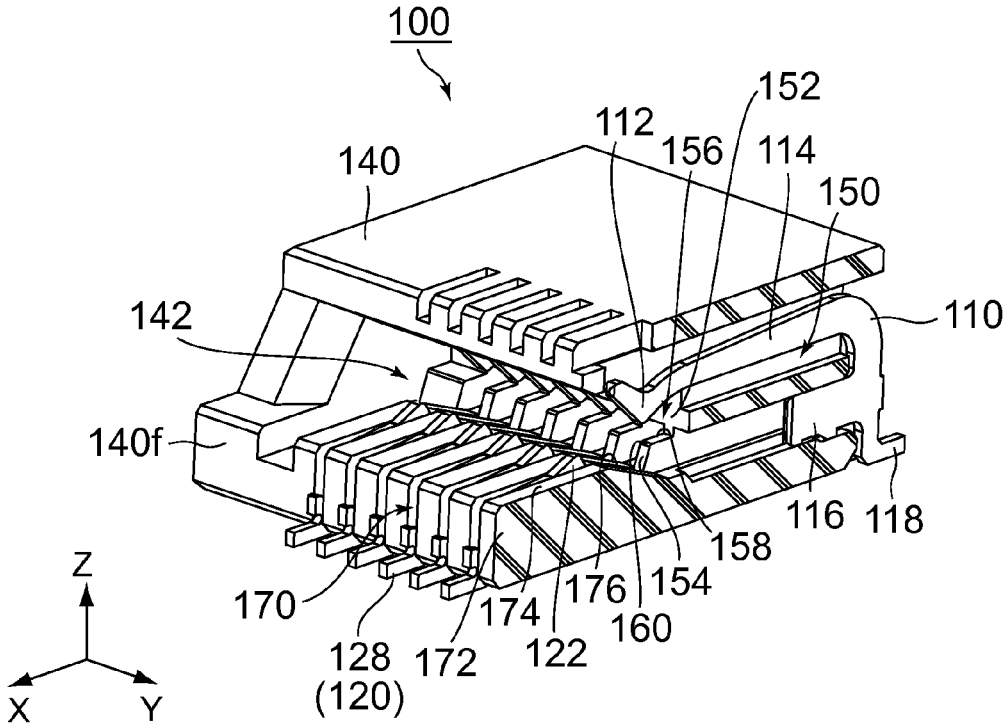
FIG. 7 is an oblique view showing a cross section of the electrical connector of FIG. 5.
Figure 8:
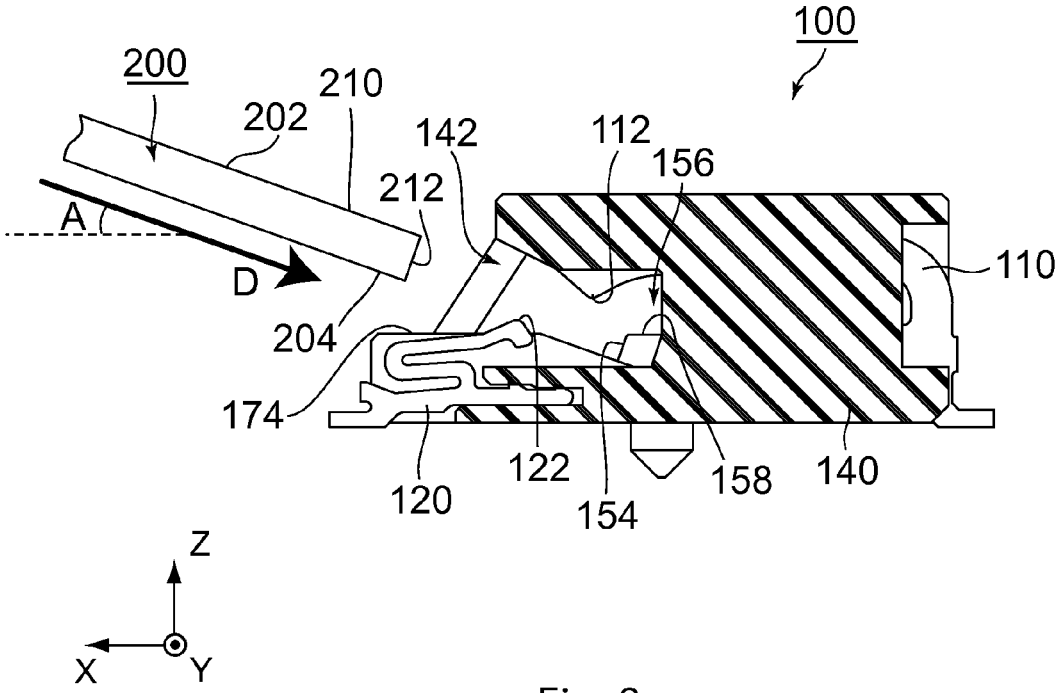
FIG. 8 is a cross-sectional view showing the electrical connector and the connection object. The connection object is not inserted into the insertion opening.

As best shown in FIG. 5 and FIG. 7, the holding member 140 has a plurality of first accommodation portions (accommodation portions) 150 formed at a back of the insertion opening 142. The first accommodation portion 150 communicates with the insertion opening 142 and opens backward of the holding portion 140. As shown in FIG. 7, the holding member 140 has a plurality of partition walls 152. The partition walls 152 are arranged along a pitch direction (a Y direction) perpendicular to the front-end direction and the up-down direction and are in parallel with the XZ surface. The first accommodation portion 150 is positioned between neighboring partition walls 152 in the pitch direction.

Figure 2:
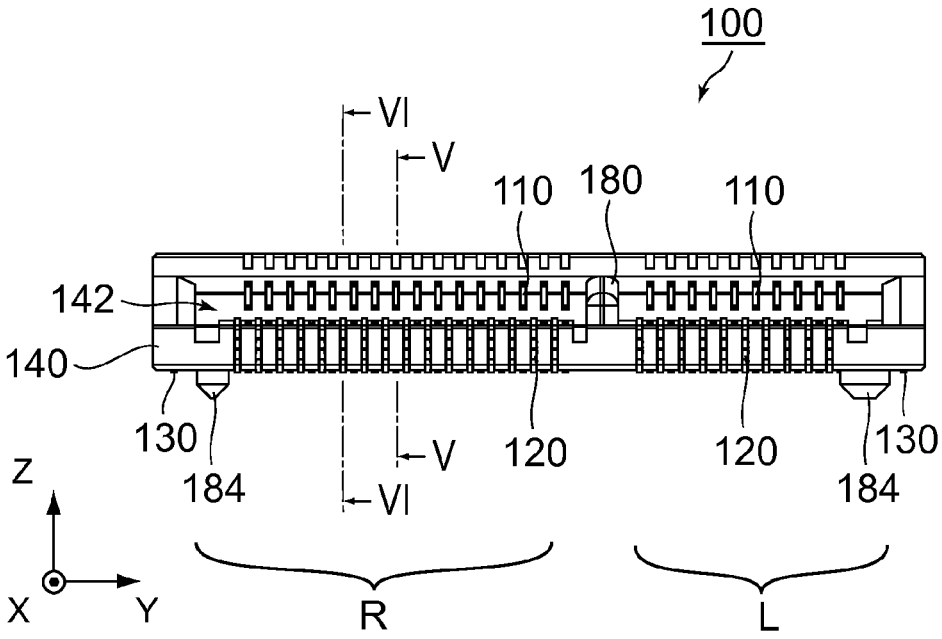
FIG. 2 is a front view showing the electrical connector of FIG. 1.
Figure 3:
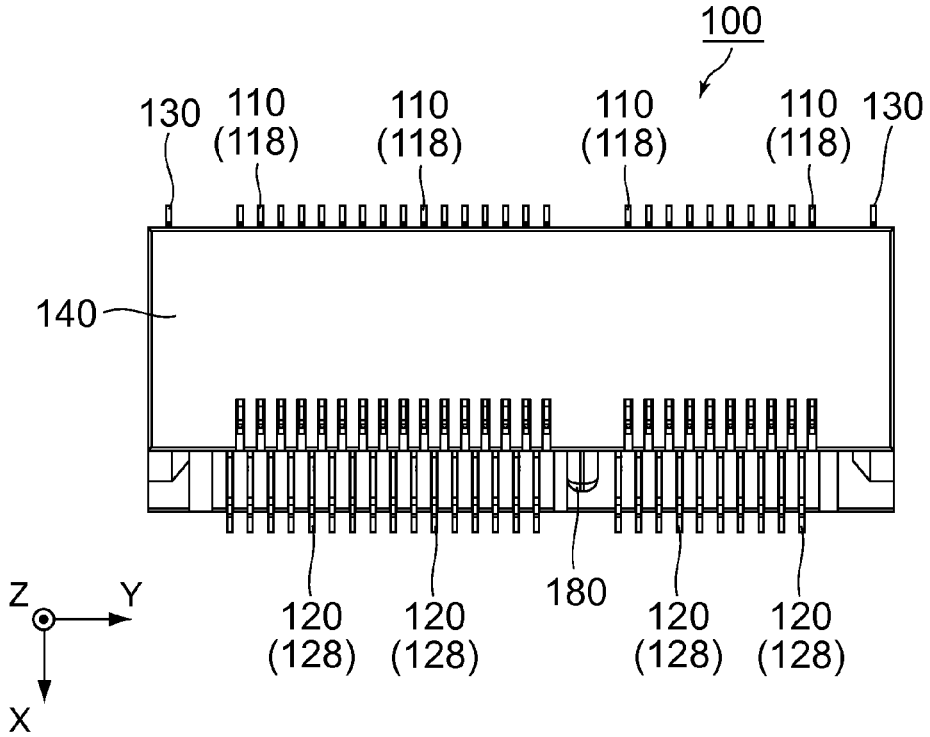
FIG. 3 is a top view showing the electrical connector of FIG. 1.

With reference to FIG. 5, the upper contact 110 is inserted into the holding member 140 so that the upper spring portion 114 is partially positioned in the first accommodation portion 150. As shown in FIG. 1 to FIG. 3, the holding member 140 holds the upper contacts 110 so that the upper contact portions 112 are arranged in a line in the pitch direction. The upper contact portions 112 are positioned in the insertion opening 142 when seen along the front-back direction. As understood from FIG. 3, the hold downs 130 are attached to opposite ends of the holding member 140 in the pitch direction. Similarly to the upper contacts 110, each of the hold downs 130 are press-fitted into and held by the holding member 140.

As shown in FIG. 5 to FIG. 7, each of the partition walls 152 has a projection portion and a recessed portion. The projection portion is formed at a lower part of the partition wall 152 and projecting forward. The recessed portion is formed upward and backward of the projection portion and recessed backward. As shown in FIG. 7, each of front surfaces of the projection portions serves as a contacted portion 154, and each of the recessed portions serves as a receiving portion 156. When the mating portion 210 is inserted through the insertion opening 142, the front end portion 212 of the mating portion 210 is brought into contact with the contacted portions 154 as described in detail afterwards.

With reference to FIG. 5 and FIG. 7, each of the receiving portions 156 has a flat surface formed at a bottom surface of the receiving portion 156. In other words, the flat surface of the embodiment is an upper surface of the above-projection portion of the partition wall 152. The flat surface of the receiving portions 156 is perpendicular to the up-down direction, i.e. in parallel with a horizontal surface (an XY surface). The flat surface serves as a first support portion 158. The first support portion 158 is positioned backward and downward of the upper contact portions 112. In other words, the upper contact portion 112 is positioned forward and upward of the first support portion 158. In this embodiment, a guide portion 160 is formed between the contacted portion 154 and the first support portion 158 in the front-back direction. The guide portion 160 has a smooth surface. The guide portion 160 may have a curved surface when seen along the pitch direction. The guide portion 160 may have an oblique surface oblique to the front-back direction and the up-down direction.

As shown in FIG. 6 and FIG. 7, a plurality of second accommodation portions 170 is formed at a front and lower part of the holding member 140. The second accommodation portion 170 communicates with the insertion opening 142 and opens forward of the holding member 140. As shown in FIG. 7, a plurality of ribs 172 is formed at a front and lower part of the holding member 140. The rib 172 is positioned between the neighboring second accommodation portions 170 in the pitch direction.

As shown in FIG. 5 to FIG. 7, each of the ribs 172 has an upper surface and an oblique surface 176. The upper surface is in parallel with the horizontal surface. The oblique surface 176 is sloped down backward from the upper surface. The upper surface of the rib 172 serves as a second support portion 174. The second support portion 174 is positioned forward and downward of the upper contact portion 112. As understood from FIG. 5 and FIG. 6, the first support portion 158 and the second support portion 174 are positioned on a same horizontal surface. In other words, positions of the first support portion 158 and the second support portion 174 in the up-down direction are equal with each other. The oblique surfaces 176 constitute a part of the insertion opening 142. As shown in FIG. 6, when seen along the pitch direction, the oblique surface 176 and the contacted portion 154 cross each other. In other words, the first support portion 158 is positioned apart from the second support portion 174 in the pitch direction. The first support portion 158 and the second support portion 174 are not positioned on the same XZ surface.

With reference to FIG. 6, the lower contact 120 is inserted into the second accommodation portion 170. The lower held portion 126 is press-fitted into the holding member 140 so that the lower contact 120 is held by the holding member 140. As shown in FIG. 1 to FIG. 3, the holding member 140 holds the lower contacts 120 so that the lower contacts 120 are arranged in a line in the pitch direction. When the lower contact 120 is attached to the holding member 140, the lower contact portion 122 is projected upward from the upper surface (i.e. the second support portion 174) of the rib 172. The lower contact portion 122 is positioned in the insertion opening 142 when seen along the front-back direction. The lower contact portion 122 is elastically supported by the lower spring portion 124 so as to be displaceable in the up-down direction.

As shown in FIG. 1 to FIG. 3, the upper contacts 110 and the lower contacts 120 are grouped into two groups (a right group R and a left group L). In other words, the first accommodation portions 150 and the second accommodation portions 170 are also grouped into the right group R and the left group L. The holding member 140 has a key 180 formed between the right group R and the left group L in pitch direction. As is clear from FIG. 2 and FIG. 3, the key 180 is not positioned at the center of the holding portion 140 in the pitch direction. In other words, the right group R and the left group L are not symmetric about the center of the hold member 140 in the pitch direction. The mating portion 210 of the connection object 200 has a key (a notch: not shown) which corresponds to the key 180. By adjusting the key of the mating portion 210 with the key 180 of the mating portion 210, the mating portion 210 can be inserted into the insertion opening 142 properly.

Figure 4:
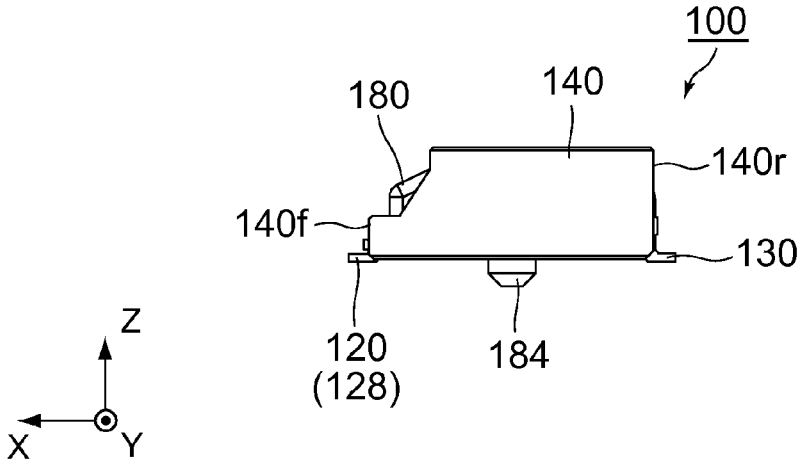
FIG. 4 is a side view showing the electrical connector of FIG. 1.

As shown in FIG. 4 to FIG. 6, the holding member 140 has two locating bosses 184. The locating bosses 184 are positioned near both ends of the holding member 140 in the pitch direction and project downward. The substrate (not shown) has two holes which correspond to the locating bosses 184. The electrical connector 100 is suitably located on the substrate by inserting the locating bosses 184 into the holes of the substrate. The upper fixed portions 118 of the upper contacts 110, the lower fixed portions 128 of the lower contacts 120 and the hold downs 130 are fixed to the substrate and connected with a conductive pattern or a soldering portion.

Figure 9:
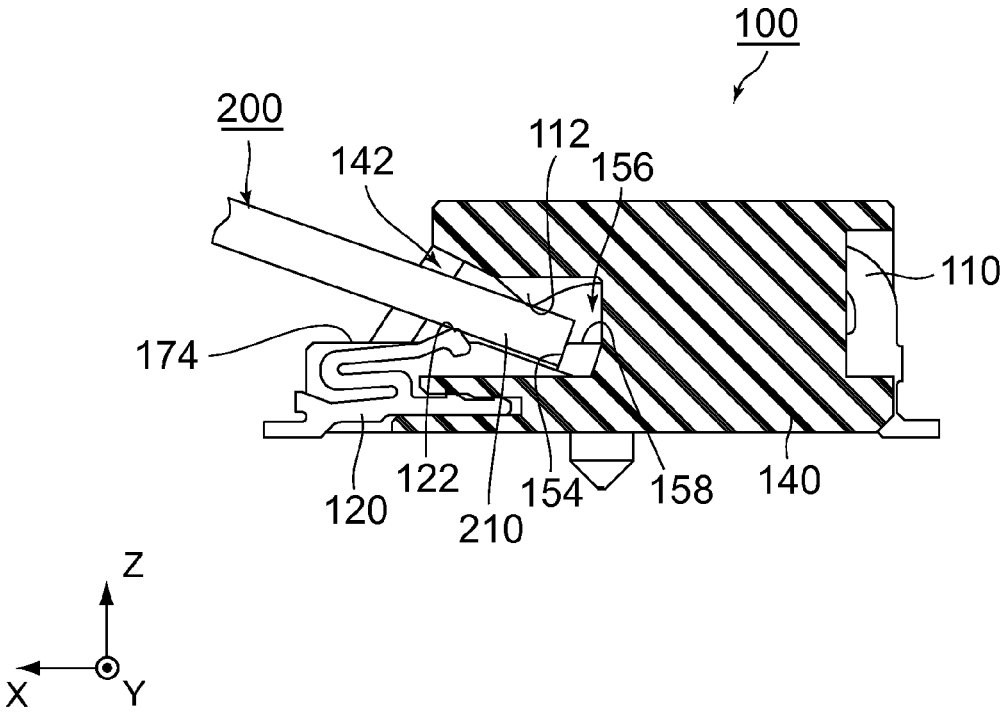
FIG. 9 is a cross-sectional view showing a first step of a connection process. The connection object is positioned at a first position.

In this embodiment, the connection object 200 is connected with the electrical connector 100 as follows. As shown in FIG. 8 and FIG. 9, the mating portion 210 of the connection object 200 is inserted into the insertion opening 142 along the oblique direction. The mating portion 210 is brought into contact with the contacted portion 154 (FIG. 9: a first position). As understood from a movement of the mating portion 210 shown in FIG. 8 and FIG. 9, when the mating portion 210 is inserted into the electrical connector 100 through the insertion opening 142, the mating portion 210 does not push the upper contact portion 112 nor the lower contact portion 122, in other words, the mating portion 210 does not receive restoring force of the upper contact 110 nor the lower contact 120. Thus, the mating portion 210 can be inserted into the insertion opening 142 with low insertion force.

Figure 10:
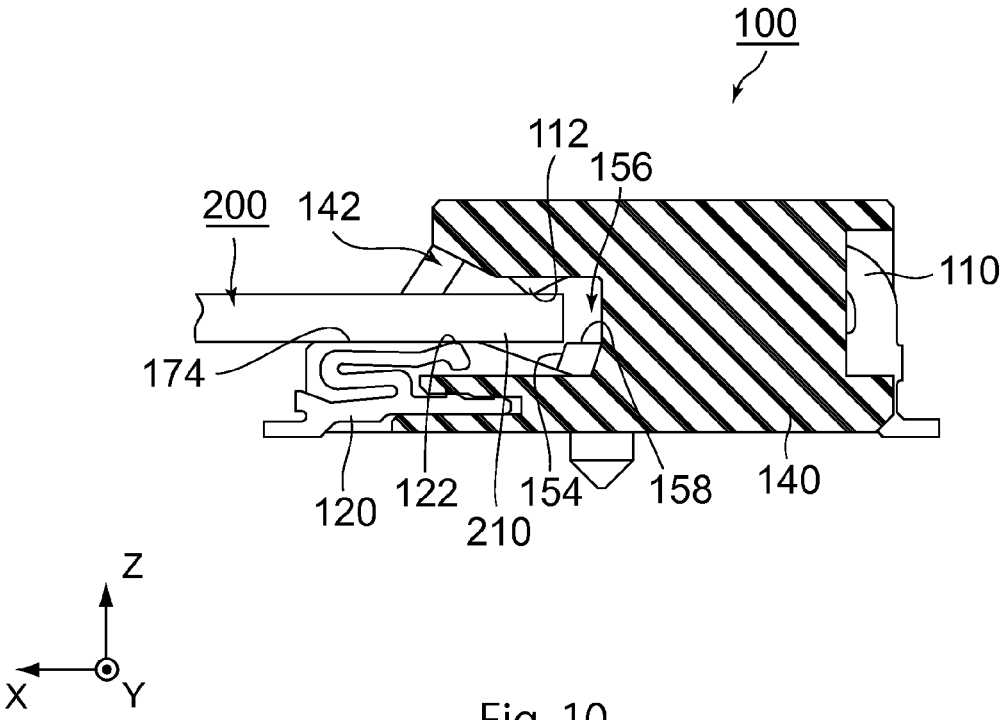
FIG. 10 is a cross-sectional view showing a second step of the connection process. The connection object is positioned at a second position.

As shown in FIG. 9 and FIG. 10, the mating portion 210 is brought down until the mating portion 210 is in parallel with the horizontal direction (FIG. 10: a second position). In the state shown in FIG. 10, the mating portion 210 pushes the upper contact portion 112 upward and the lower contact portion 122 downward. The mating portion 210 received the restoring forces from the upper contact 110 and the lower contact 120.

Figure 11:
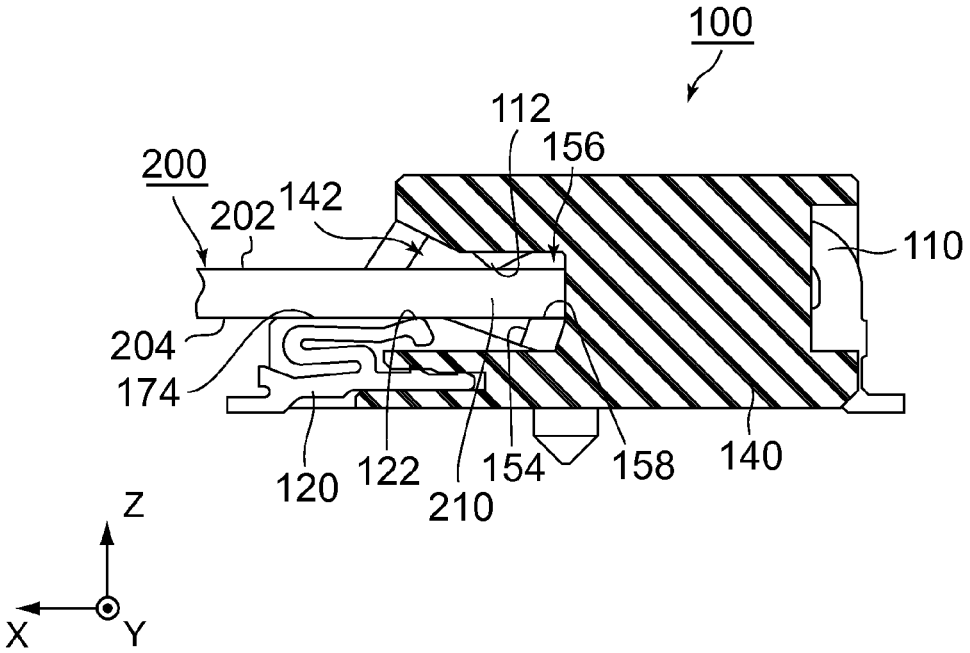
FIG. 11 is a cross-sectional view showing a third step of the connection process. The connection object is positioned at a third position.

As shown in FIG. 10 and FIG. 11, the mating portion 210 is moved backward so that the receiving portion 156 receives the mating portion 210 (FIG. 11: a third position). The guide portion 160 guides the mating portion 210 to smoothly move from the second position to the third position. Because of the guide portion 160, the mating portion 210 is not obstructed by an upper end part of the contacted portion 154. As a variation example of the guide portion 160, the mating portion 210 may have a curved surface formed at the front end portion 212 (FIG. 8), thus the guide portion 160 of the holding member 140 may be omitted. With this structure, the curved surface of the mating portion 210 guides the mating portion 210 to smoothly move from the second position to the third position.

As shown in FIG. 11, when the mating portion 210 is positioned at the third position, the first support portion 158, the second support portion 174 and the upper contact portion 112 support the mating portion 210. The upper contact portion 112 is electrically connected with the upper contact (not shown) of the mating portion 210. The lower contact portion 122 is electrically connected with the lower contact (not shown) of the mating portion 210.

As shown in FIG. 11, the electrical connector 100 is supported by three points (the first support portion 158, the second support portion 174 and the upper contact portion 112) seen along the pitch direction. In detail, the upper contact portion 112 pushes the upper surface 202 of the mating portion 210 while the first support portion 158 and the second support portion 174 support the lower surface 204 of the mating portion 210. The upper contact portion 112 is positioned between the first support portion 158 and the second support portion 174 in the front-back direction. In other words, for the mating portion 210, a pushed area pushed by the upper contact portion 112 is positioned between a supported area supported by the first support portion 158 and a supported area supported by the second support portion 174 in the front-back direction. Therefore, the mating portion 210 does not receive undesired force which may bend and deform the mating portion 210. Even if the mating portion 210 has a thin shape, the mating portion 210 can be inserted smoothly, and the electrical connector 100 can maintain a connection with the connection object 200.

Figure 12:
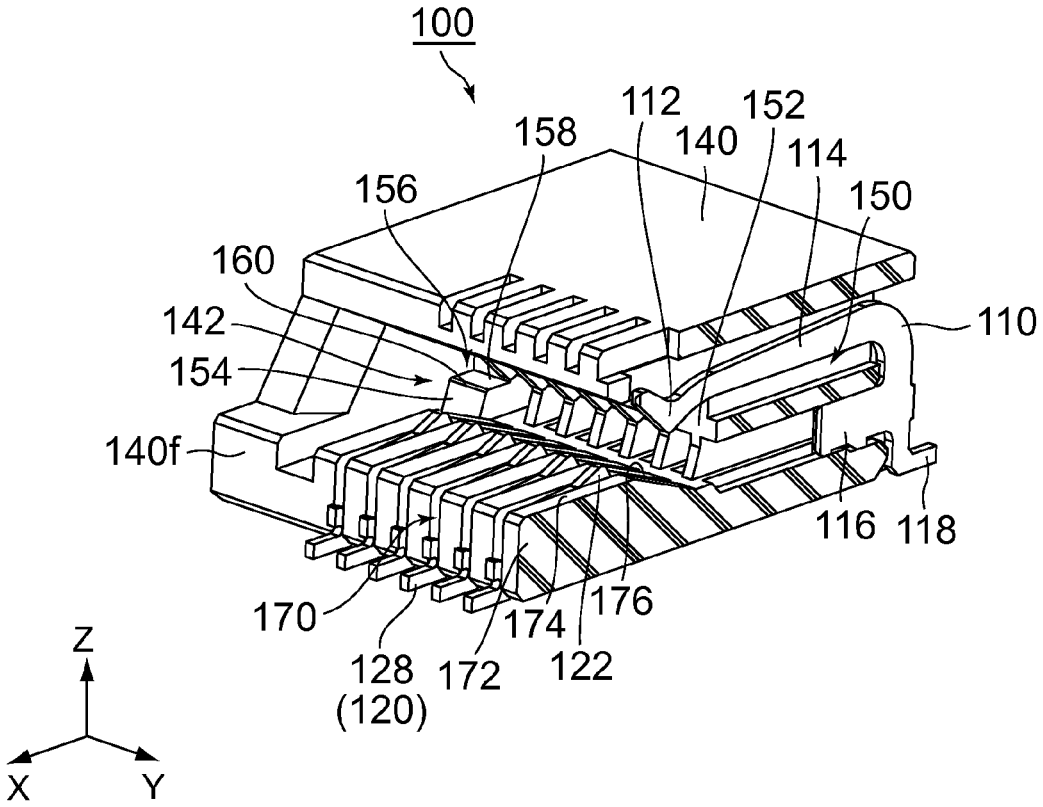
FIG. 12 is an oblique view showing a cross section of a first variation example of the electrical connector of FIG. 7.

In the above embodiment, the contacted portion 154 and the receiving portion 156 are integrally formed with the partition wall 152 (see FIG. 7). However, the contacted portion 154 and the receiving portion 156 may be formed apart from the partition wall 152 in the pitch direction. FIG. 12 shows a first variation example. As understood from FIG. 12, the electrical connector 100 has two contacted portions 154 and two receiving portions 156. The contacted portions 154 and the receiving portions 156 are formed near both ends of the insertion opening 142 in the pitch direction.

The upper surface of the rib 172 serves as the second support portion 174. However, for example, the lower contact portion 122 may serve as the second support portion. In this case, the lower spring portions 124 of the lower contacts 120 may be strengthened so as to support the mating portion 210. In another example, the upper surface of the rib 172 and the lower contact portion 122 may serve as the second support portion.

Figure 13:
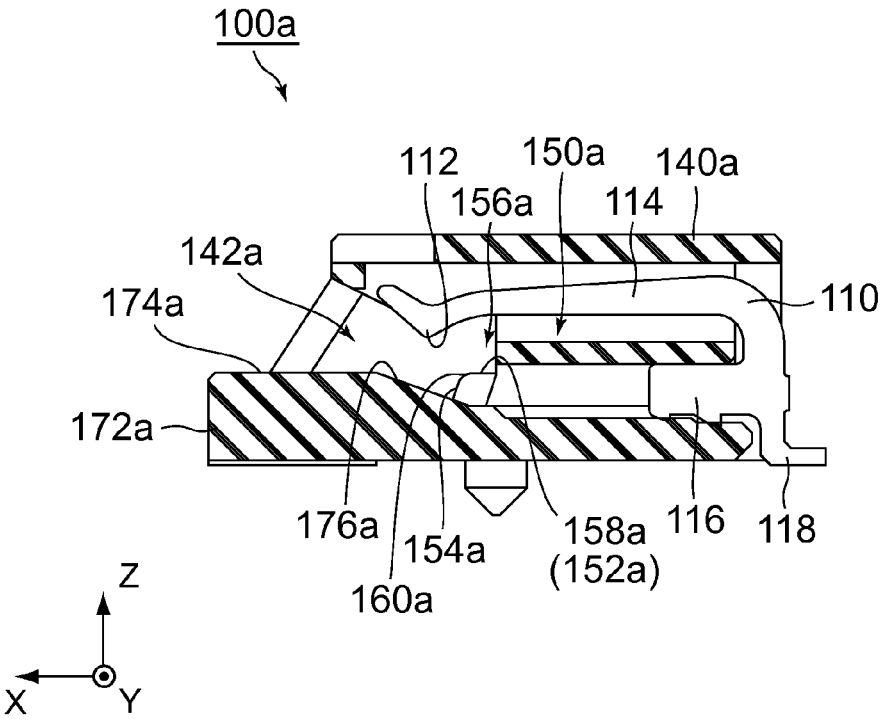
FIG. 13 is a cross-sectional view showing a cross section of a second variation example of the electrical connector of FIG. 5.
Figure 14:
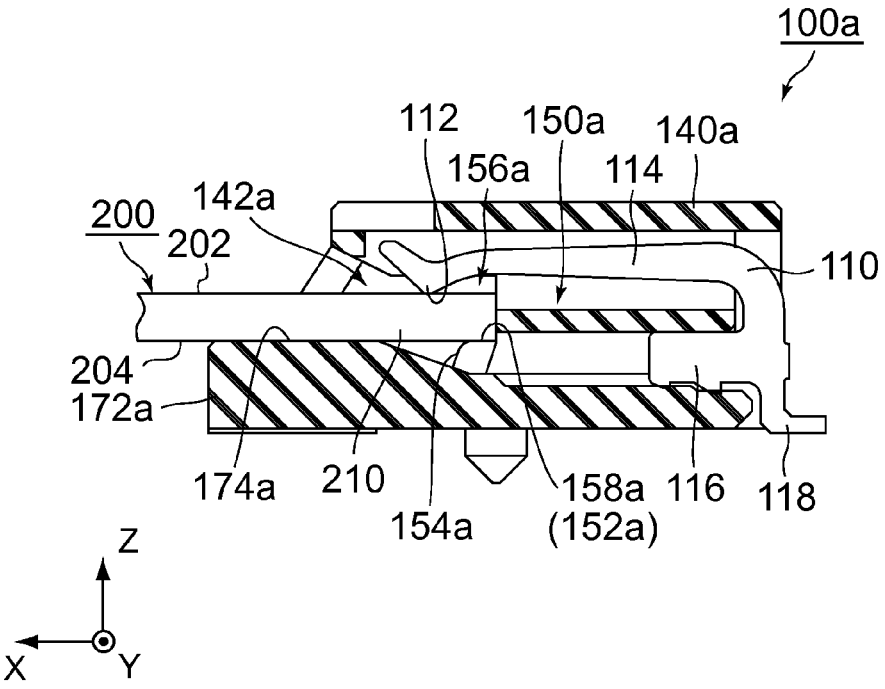
FIG. 14 is a cross-sectional view showing the electrical connector and a connection object of FIG. 13. The connection object is positioned at the third position.

FIG. 13 and FIG. 14 show a second variation example. An electrical connector 100*a* does not have the lower contact portion 120 (FIG. 6). The connector 100*a* is connected with a mating portion 210 which has no contacts at the lower surface 204. As shown in FIG. 13, a holding member 140*a* of the electrical connector 100*a* does not have the second accommodation portions 170 nor the ribs 172 (FIG. 12) but has a first accommodation portions 150*a* a lower support portions 172*a*.

A shape of the lower support portion 172*a* is similar to the rib 172 (FIG. 12) in cross-section seen along the pitch direction. The lower support portion 172*a* has an upper surface and a slope 176*a*. The upper surface is perpendicular to the up-down direction and serves as a second support portion 174*a*.

As shown in FIG. 13, the holding member 140*a* has contacted portion 154*a* and receiving portion 156*a*. The receiving portion 156*a* is positioned backward and upward of the contacted portion 154*a*. The receiving portion 156*a* has a bottom surface which serves as a first support portion 158*a*. A guide portion 160*a* is formed between the contacted portion 154*a* and the first support portion 158*a* in the front-back direction. The first support portion 158*a* and the second support portion 174*a* are positioned on a same horizontal surface.

As shown in FIG. 14, the electrical connector 100*a* supports the mating portion 210 at three points (the first support portion 158*a*, the second support portion 174*a* and the upper contact portion 112). In other words, for the mating portion 210*a*, a pushed area pushed by the upper contact portion 112 is positioned between a supported area supported by the first support portion 158*a* and a supported area supported by the second support portion 174*a* in the front-back direction. Therefore, the mating portion 210 does not receive undesired force which may bend or deform the mating portion 210.

Figure 15:
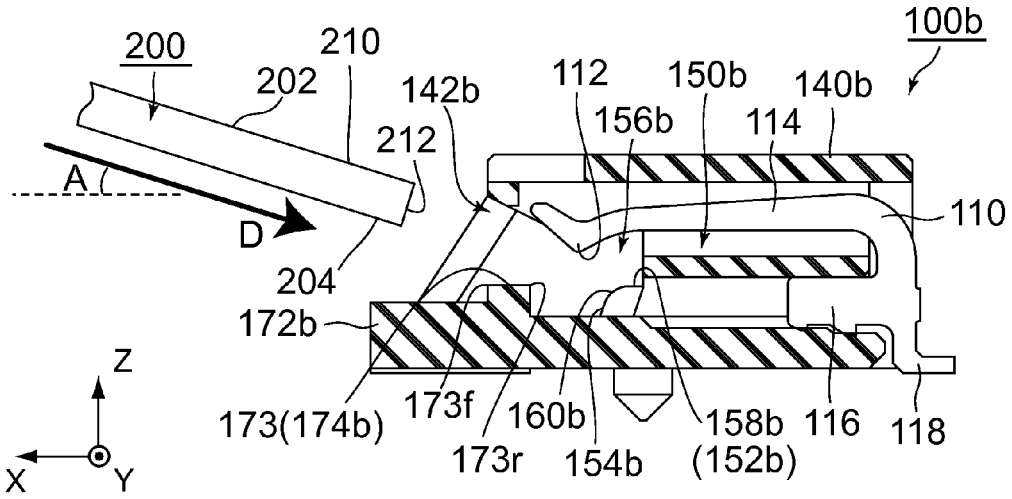
FIG. 15 is a cross-sectional view showing a third variation example of the electrical connector of FIG. 5. The connection object is not inserted into the insertion opening.
Figure 16:
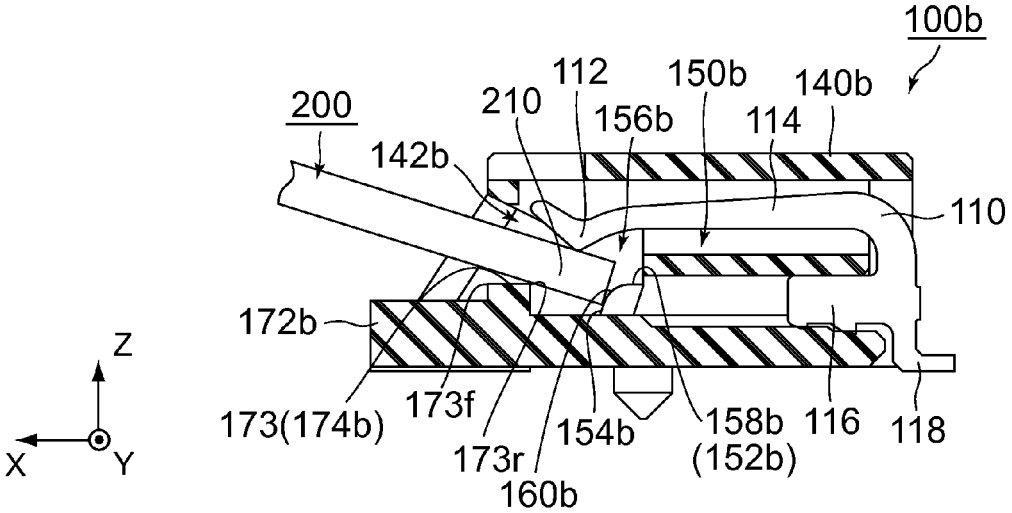
FIG. 16 is a cross-sectional view showing the electrical connector of FIG. 15. The connection object is positioned at the first position.
Figure 17:
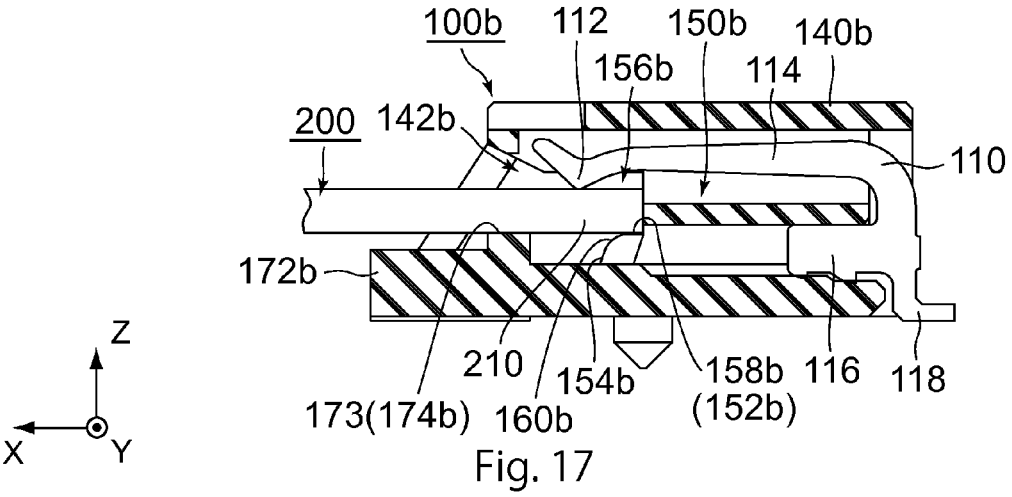
FIG. 17 is a cross-sectional view showing the electrical connector of FIG. 15. The connection object is positioned at the third position.

FIG. 15 to FIG. 17 show a third variation example. The electrical connector 100*b* does not have the lower contact 120 (FIG. 11) but has a lower support portion 172*b* which has a projection 173. The holding member 140*b* of the electrical connector 100*b* has first accommodation portions 150*b* and an insertion opening 142*b*. The lower support portion 172*b* is positioned forward and downward of the insertion opening 142*b*.

As shown in FIG. 15, an upper surface of the projection 173 serves as the second support portion 174*b*. As shown in FIG. 16, the upper surface of the projection 173 has a front edge 173*f* and a rear edge 173*r*. The rear edge 173*r* makes the lower limit of the insertion opening 142*b*. The lower surface 204 of the mating portion 210 slides on the rear edge 173*r* when the mating portion 210 is inserted into the insertion opening 142*b*.

The holding member 140*b* has contacted portion 154*b* and receiving portion 156*b*. The receiving portion 156*b* is positioned backward and upward of the contacted portion 154*b*. The receiving portion 156*b* has a bottom surface which serves as a first support portion 158*b*. A guide portion 160*b* is formed between the contacted portion 154*b* and the first support portion 158*b* in the pitch direction. The first support portion 158*b* and the second support portion 174*b* are positioned on a same horizontal surface. As shown in FIG. 15, the guide portion 160*b* of the embodiment has a curved surface.

As shown in FIG. 15 to FIG. 17, the mating portion 210 is connected with the electrical connector 100*b* as follows. The mating portion 210 is inserted into the insertion opening 142*b* in the oblique direction. The lower surface 204 of the mating portion 210 slides on the rear edge 173*r* of the second support portion 174*b* and moves till the mating portion 210 is brought into contact with the contacted portion 154*b* (FIG. 16: a first position). The mating portion 210 is brought down till the mating portion 210 is in parallel with horizontal direction (a second position). The mating portion 210 is moved backward and is received by the receiving portion 156*b* (FIG. 17: a third position). In this embodiment the guide portion 160*b* has the curved surface. As understood from FIG. 16 and FIG. 17, when the mating portion 210 is brought down, the front end portion 212 of the mating portion 210 slides on the curved portion of the guide portion 160*b* and is guided to the receiving portion 156*b*. In this embodiment, the mating portion 210 is immediately moved from the second position to the third position. The electrical connector 100*b* supports the mating portion 210 at three points (the first support portion 158*b*, the second support portion 174*b* and the upper contact portion 112). Therefore, the mating portion 210 does not receive undesired force which may bend or deform the mating portion 210.

Each of the first support portions 158, 158*a*, 158*b* and the second support portions 174, 174*a*, 174*b* has the upper surface in parallel with the horizontal surface. However, at least one of the first support portion 158, 158*a*, 158*b* or the second support portion 174, 174*a*, 174*b* may have a projection shape. Even in this case, it is preferred that the first support portion and the second support portion are positioned at the same horizontal surface.

In above-described embodiment, each of the second support portions 174, 174*a*, 174*b* is a part of the holding member 140, 140*a*, 140*b*. However, the lower contact portion 122 may serve as the second support portion. In other words, the only lower contact portion 122 of the lower contact 120 may support the mating portion 210, and the upper surface of the rib 172 (FIG. 7) and the lower support portion 172*a*, 172*b* (FIG. 13 and FIG. 15) does not support the mating portion 210. In this case, it is preferred that the lower contact portion (the second support portion) 122 and the first support portion 158, 158*a* or 158*b* is positioned on the same horizontal surface.

The electrical connectors 100, 100*a*, 100*b* of the embodiments can be connected with the connection 200 object without the engage portion (the latch portion) of the JP-A H9-139261. However, the electrical connector of the present invention may use a latch means accessorily.

The present application is based on a Japanese patent application of JP 2011-142287 filed before the Japan Patent Office on Jun. 27, 2011, the contents of which are incorporated herein by reference.

While there has been described what is believed to be the preferred embodiment of the invention, those skilled in the art will recognize that other and further alternative embodiments may be made thereto without departing from the spirit of the invention, and it is intended to claim all such embodiments that fall within the true scope of the invention.

What is claimed is:

1. An electrical connector configured to be connected with a connection object which has a mating portion having a plate shape, wherein the electrical connector comprises:

an insertion opening into which the connection object is inserted in an oblique direction;

a contacted portion with which the mating portion inserted through the insertion opening is brought into contact;

a receiving portion receiving the mating portion and having a first support portion, the receiving portion being positioned at a back of the contacted portion;

a contact portion positioned forward and upward of the first support portion and being displaceable in an up-down direction; and a second support portion positioned forward and downward of the contact portion, the mating portion being inserted through the insertion opening so as to be positioned at a first position where the mating portion is in contact with the contacted portion, the mating portion being brought down so as to be positioned at a second position where the mating portion is in parallel with a front-back direction perpendicular to the up-down direction, the mating portion being moved backward so as to be positioned at a third position where the mating portion is received by the receiving portion and supported by the first support portion, the second support portion, and the contact portion.

2. The electrical connector according to claim 1, wherein a mating contact is formed on the mating portion, the mating contact being connected with the contact portion when the mating portion is positioned at the third position.

3. The electrical connector according to claim 1, wherein the electrical connector further comprises plurality of upper contacts and a holding member which holds the upper contacts in a pitch direction perpendicular to the front-back direction and the up-down direction, each of the upper contacts having an upper contact portion and a spring portion, the upper contact portion serving as the contact portion, the spring portion elastically supporting the upper contact portion, the contacted portion and the receiving portion being formed as a part of the holding member.

4. The electrical connector according to claim 3, wherein the receiving portion has a flat surface formed at a bottom of the receiving portion, the flat surface being perpendicular to the up-down direction and serving as the first support portion.

5. The electrical connector according to claim 4, wherein a guide portion is formed between the contacted portion and the first support portion, the guide portion connecting the contacted portion and the first support portion smoothly.

6. The electrical connector according to claim 3, wherein the second support portion is formed as a part of the holding member.

7. The electrical connector according to claim 3, wherein the electrical connector further comprises a plurality of lower contacts, the holding member holding the lower contacts in the pitch direction, each of the lower contacts having a lower contact portion serving as the second support portion.

8. The electrical connector according to claim 6, wherein an upper end of the first support portion and an upper end of the second support portion are positioned on a same horizontal surface.

9. The electrical connector according to claim 3, wherein the holding member has a plurality of accommodation portions and a plurality of partition walls, each of the accommodation portions being positioned between the neighboring ones of the partition walls, the contacted portion and the receiving portion being formed at the partition wall.

10. The electrical connector according to claim 3, wherein the holding member has a plurality of accommodation portions and a plurality of partition walls, each of the accommodation portions being positioned between the neighboring ones of the partition walls, the contacted portion and the receiving portion being formed so as to be positioned apart from the partition wall in the pitch direction.

11. The electrical connector according to claim 1, wherein the connection object is a module having a circuit board, the electrical connector being a card-edge connector connected with the module.

12. The electrical connector according to claim 7, wherein an upper end of the first support portion and an upper end of the second support portion are positioned on a same horizontal surface.

* * * * *